United States Patent [19]

Oka

[11] Patent Number: 4,969,557

[45] **Date of Patent: * Nov. 13, 1990**

[54] TONER CARTRIDGE

[75] Inventor: Seiji Oka, Kawasaki, Japan

[73] Assignee: Ricoh Co., Ltd., Tokyo, Japan

[ * ] Notice: The portion of the term of this patent subsequent to May 13, 2005 has been disclaimed.

[21] Appl. No.: 801,931

[22] Filed: Nov. 26, 1985

[51] Int. Cl.[5] ..... B65D 51/00; B65D 43/02

[52] U.S. Cl. ..... 206/527; 222/DIG. 1; 206/467; 141/364; 141/366

[58] Field of Search ..... 206/467, 468, 527; 229/43; 160/23; 222/DIG. 1, 325; 141/364, 366

[56] References Cited

U.S. PATENT DOCUMENTS

| | | | |
|---|---|---|---|
| 4,062,385 | 12/1977 | Katusha et al. | 141/89 |
| 4,167,234 | 9/1979 | Gordon et al. | 220/359 |
| 4,237,943 | 12/1980 | Ermel et al. | 141/284 |
| 4,491,161 | 1/1985 | Tamura et al. | 222/DIG. 1 |

FOREIGN PATENT DOCUMENTS

| | | | |
|---|---|---|---|
| 93471 | 5/1984 | Japan | 286/527 |

*Primary Examiner*—William Price
*Assistant Examiner*—Brenda J. Ehrhardt
*Attorney, Agent, or Firm*—Cooper & Dunham

[57] ABSTRACT

A toner cartridge is provided for use in replenishing toner to a toner storing section of an imaging machine, such as a copying machine, which uses toner to produce a visible image. The toner cartridge includes a container having an opening, a folded over seal member having one end fixed to the container and another end fixed to a roller, and means for winding up the seal member which includes a roller provided with a shaft. When the shaft is rotated, the seal member is peeled off the container to unseal its opening. The toner drops from the container into the toner storing section. The seal member can be easily peeled off from the container, and toner is kept from being spilled and from soiling the operator.

17 Claims, 2 Drawing Sheets

TONER CARTRIDGE

BACKGROUND AND SUMMARY OF THE INVENTION

This invention relates to a toner cartridge for supplying toner to various types of imaging machines, such as electrophotographic copiers, facsimile machines and laser printers, which use toner to form visible images, and particularly to a toner cartridge generally including a container which contains therein a quantity of toner and has an initially sealed opening which can be unsealed, as by separating the seal member from the opening, to dump the toner from the container into a toner storing section.

In various types of imaging machines, such as electrophotographic copiers, which use toner to form visible images, toner must be replenished from time to time because it is expended as imaging is carried out. For example, in a typical copying machine, an electrostatic latent image is first formed on a photoconductive member and then the latent image is developed by applying toner thereon to convert the latent image into a visible toner image, which is then transferred to a transfer medium such as paper, followed by the step of fixing the transferred image to the transfer medium. Accordingly, in a copying machine, a toner storing section is typically provided adjacent to its developing device to supply toner to the developing device from the toner storing section. However, when the toner stored in the toner storing section is used up, fresh toner must be added to the toner storing section in order to maintain a proper developing operation. Several approaches have been proposed in the past to carry out a toner replenishment operation.

In accordance with one of the proposed approaches, a toner bottle containing therein a quantity of toner is used. In this case, a lid provided on the top of the toner storing section is opened and the toner bottle with its cap removed is turned upside down to pour the toner from the container into the toner storing section. This approach is quite simple, but toner can be spilled and scattered as this takes place. For example, toner may be spilled when the lid of the toner storage section lid is opened, when the cap is removed from the bottle, and when the bottle is turned upside down. Spilled and scattered toner can contaminate the copying machine and its surrounding area, and can impair performance. The operator's hands can be soiled, and the toner can be harmful if inhaled deeply. Thus, this approach has certain disadvantages.

In accordance with another prior art approach, it is proposed to use a cartridge type toner container containing therein a quantity of toner, which may be detachably mounted at the top of a toner storing section and which has its opening initially sealed by a seal member. In accordance with this approach, when mounting the toner cartridge, the seal member must be removed and the cartridge must be set in position for causing the fresh toner to replenish the used up toner in the toner storing section. This approach, however, also suffers from disadvantages similar to those of the first approach described above. For example, toner spillage and scattering can take place when the seal is removed.

In addition, the seal usually is well adhered to the container, as by using strong adhesives, so that the seal would not peel off if the toner cartridge is subjected to rough handling during shipping. Therefore, a strong pull by the operator may be needed to remove the seal member from the container, and as a result toner may spill and toner adhered to the inside surface of the seal member may soil the hands or clothing of the operator.

Further, toner particles adhere to the entire inside surface of the seal member when the seal member is removed from the container. As the seal member is normally too long and thin to handle easily, it is difficult not to touch it while supplying toner to the toner storing section.

Other known prior art approaches also suffer from similar disadvantages, and it is believed that none of them solves the problem of toner spillage and scattering completely. Moreover, it is important that the toner replenishment operation can be carried out without requiring special experience and special skills from the copier user.

One recently introduced toner cartridge is described in U.S. patent application Ser. No. 584,624 filed on Feb. 29, 1984 for. This toner cartridge has a container, a cover which is supported to be slidably movable between a closed position to close an opening of the container and an open position to open the opening, and a seal member having one end fixed to the container and another end fixed to the cover. When the cover is moved from its closed position to its open position, the seal member is partly separated away from the container to open it halfway, and then the seal member is pulled further by the operator, to completely open the opening and thereby completely discharge the toner from the container. This cartridge needs a sliding cover in addition to the seal member, and exposes the machine and the operator to the underside of the peeled-off seal member, which usually has toner adhered to it.

Accordingly, the invention is directed to providing a toner cartridge which overcomes these and other shortcomings of the known prior art.

In a nonlimiting example of an embodiment of the invention, the toner cartridge comprises a container which contains therein a quantity of toner to be replenished into the toner storing section and has an opening. A seal member has a first portion which is initially adhered to the container to close the opening. A means for winding up the seal member takes up the free end of a second portion of the seal member and peels off the initially adhered portion to open said opening, whereby toner is added from the container into the toner storing section.

The toner cartridge is arranged such that the seal member can be easily removed from the container by using the winding up means even if the seal member is adhered well to the container, and can replenish a large amount of toner easily, without causing spillage or scattering of toner and without a need for the operator to touch the seal member directly. Furthermore, it is easy to dispose of the seal member after it is wound up without spillage or scattering of toner and without soiling the machine or the operator.

DETAILED DESCRIPTION

Figure 1A:
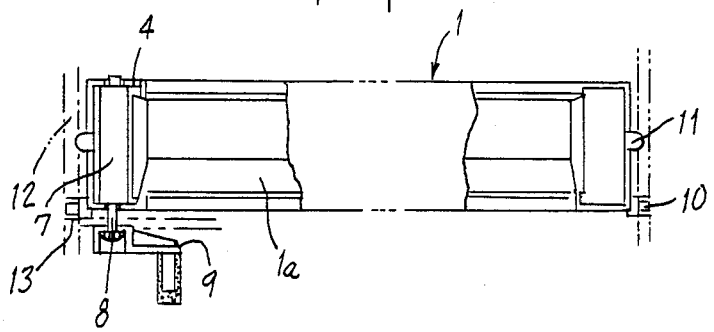
FIGS. 1*a* and 1*b* are a top view and a side view, respectively, of a toner cartridge constructed in accordance with one embodiment of the invention, oriented as it would be when mounted in a machine such as a copying machine.
Figure 1B:
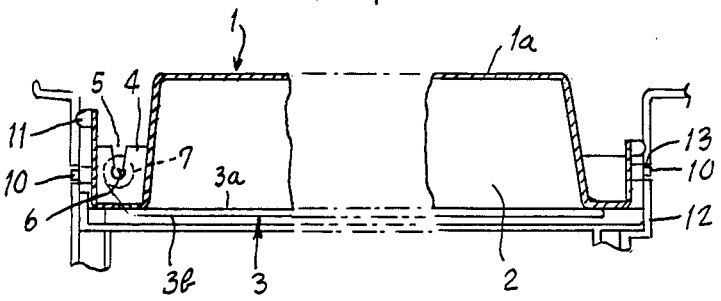
Figure 2:
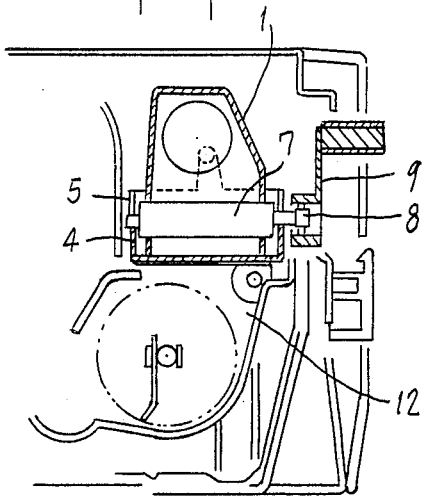
FIG. 2 is a front sectional view showing an example of the toner cartridge as used in a copying machine.

Referring now to FIGS. 1*a*, 1*b* and 2, there is shown a toner cartridge 1 constructed in accordance with one embodiment of the present invention. FIG. 1*a* is a top view, FIG. 1*b* is a side view and FIG. 2 is a front sectional view showing an example of the present cartridge as used in a copying machine. As shown, the toner cartridge 1 comprises a container 1*a*, which includes a top wall and a pair of long and a pair of short sidewalls defining a storage space generally in the shape of a rectangular receptacle for storing therein a quantity of toner. An opening 2 is defined by the bottom ends of the sidewalls of the toner cartridge 1. A seal member 3 is slightly longer than twice the long dimension of the container 1*a* and is initially folded over, with its portion 3*a* initially adhesively attached to the entire periphery of the opening 2 from one end of the short sidewalls of the container 1*a* to the other, to seal and close the opening 2. A folded over portion 3*b* of the seal member is directly under portion 3*a*, running in the other direction. Two brackets 4 are integrally formed with the left sidewall of the container 1*a* near a first end of the seal member 3. Each bracket 4 has an elongated aperture 6 which forms an upwardly facing slot 5 for detachably inserting therein the shaft 8 of a wind up roller 7 such that the shaft is rotatably supported by the brackets. The free end of the portion 3*b* is fixed on the surface of the roller 7. A handle 9 is detachably mounted on the shaft 8 of the roller 7 to rotate the roller 7.

Numerals 10, 10 refer to pins which are provided on both end portions of the toner cartridge 1 to engage holes 13, 13 which are formed on the sidewalls of a toner hopper 12 of a developing unit, to journal the toner cartridge 1 in hopper 12. Numerals 11, 11 refer to projections which are provided on the same end portions of the toner cartridge 1 as pins 10, 10 and engage click stop depressions formed on the sidewalls of the toner hopper 12 of the developing unit. When the toner cartridge 1 is being set in the copying machine, the pins 10, 10 engage holes 13, 13 first, and then the toner cartridge 1 is rotated around the pins 10, 10 to make the opening 2 face downwardly. Finally the projections 11, 11 engage matching click stop depressions formed on the sidewalls of the toner hopper 12.

Figure 3A:
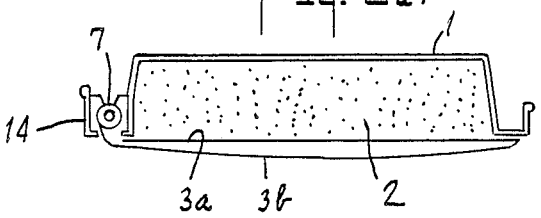
FIGS. 3*a* and 3*b* are explanatory views showing the removal of the seal member from the container.
Figure 3B:
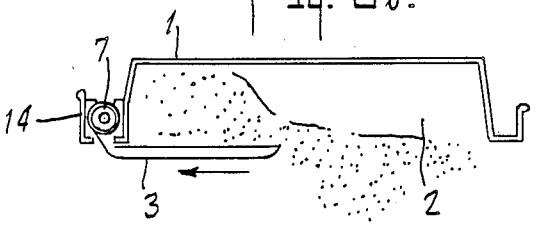

When roller 7 is rotated in a clockwise direction in FIG. 3*a* and 3*b*, it begins to wind up the seal member 3. As portion 3*b* is wound up on roller 7, it begins to peel portion 3*a*, which was initially adhered to the container 1*a*, which unseals and opens opening 2, and the toner contained in the container 1*a* drops into hopper 12 as shown in FIG. 3*b*. A convenient wind-up mechanism is thus provided.

After the entire seal member 3 is wound up on the roller 7, the handle 9 is removed from the shaft 8. The roller 7, with the seal member 3 wound on it, can be detached from the bracket 4 of the toner cartridge 1 and disposed. A guard wall 14 partly encloses roller 7, and the seal member wound on it, to keep it from soiling the hands or clothing of an operator, or other parts of the machine.

The toner which may remain adhered to the inside of the container 1*a* can be shaken off by swinging the toner cartridge 1 around pins 10, 10 as axis after releasing the engagement between projections 11, 11 and their matching depressions.

When additional toner is required, the now empty toner cartridge 1 mounted in a copying machine is removed by disengaging the projections 11, 11 from their matching depressions, rotating the toner cartridge 1 around the pins 10, 10 so as to face the opening 2 up and disengaging pins 10, 10 from holes 13 and lifting the toner cartridge 1. A new toner cartridge can be mounted and emptied into hopper 12 as described above.

As described above, the seal member 3 can be wound up on the roller 7 manually. However, as an alternative a driving connection can be provided between roller 7 of a cartridge mounted in hopper 12 as described and a driving member such as a gear driven to rotate by electric power to peel off such member 3 as above described.

While the above provides a full and complete disclosure of the preferred embodiment of the present invention, various modifications, alternate constructions and equivalents may be employed without departing the true spirit and scope of the invention. Therefore, the above description and illustration should not be construed as limiting the scope of the invention, which is defined by the appended claims. Of course, directional terms such as top, bottom, etc., are used only for convenience when referring to the exemplary position illustrated in FIGS. 1*b*, 2 and 3*a* and 3*b*, and are not meant as limitations on the scope of the appended claims.

I claim:

1. A toner cartridge comprising:

a container for containing therein a quantity of toner, said container having an opening;

a seal member having a first portion which is initially adhered to said container to close said opening and keep the toner in the container, and a second portion;

means for winding up said seal member, starting with said second portion, to thereby separate said seal member from said container and open said opening and allow the toner to leave the container, said means for winding up including a rotatable roller for winding said seal member thereon.

2. A toner cartridge as in claim 1 wherein said seal member initially is folded where its first and second portions join, and said means for winding up is provided near the end of the first portion of the seal member which is remote from said fold.

3. A toner cartridge as in claim 1 wherein said means for winding up comprises a shaft which is fixed to said roller and is rotatably supported by the container.

4. A toner cartridge as in claim 3 including a handle which is detachably mounted at one end of the shaft to rotate it.

5. A toner cartridge as in claim 4 wherein said handle is removable from the container after the winding up of the seal member is completed.

6. A toner cartridge as in claim 3 further comprising a pair of brackets which have respective elongated apertures respectively and are provided at one end portion of the container, wherein the shaft is rotatably supported in said apertures.

7. A toner cartridge comprising:

a container which is capable of storing a quantity of toner and has an opening;

a flexible seal which has a first portion adhered to the container to close said opening and a second portion which is folded over the first portion;

a winding mechanism which is secured to the container and to which the second portion of the seal member is secured, and which can be wound to gradually peel off the first portion of the seal member from the container and thereby unseal the opening and allow toner to leave the container, said mechanism including a rotatable roller on which the seal member can be wound.

8. A toner cartridge as in claim 7 in which the cartridge is elongated and the opening is along the long dimension of the cartridge and seal member peels off along said long dimension.

9. A toner cartridge as in claim 8 in which the roller is rotatable about an axis transverse to the long dimension of the cartridge and the seal member is secured to said roller to be would thereon.

10. A toner cartridge comprising:

an elongated, generally box-shaped container for toner formed by a top wall and two long and two short sidewalls, said container having an elongated, open bottom;

a winding mechanism secured to the outside of one of the short sidewalls and having a roller rotatable about an axis transverse to the long dimension of the container; and an elongated, flexible seal which is wider than the short dimension of the open bottom and extends from the short sidewall to which the winding mechanism is secured to the other sidewall and is adhered to the container to close its open bottom, and then extends back toward the winding mechanism and has a free end secured to said roller;

wherein said roller can be rotated to wind up said seal member on the roller and thereby gradually peel off the seal member from the container and unseal said open bottom to allow toner to leave the container.

11. A toner cartridge as in claim 10 in which the container includes means for engaging and interlocking with a machine using toner to develop latent images.

12. A toner cartridge as in claim 10 in which the winding mechanism includes a handle secured to the roller to rotate it by hand.

13. A toner cartridge as in claim 10 in which the winding mechanism includes a shaft which is coaxial with and is secured to the roller, and the container includes a pair of brackets which are integrally formed therewith and have open slots into which the shaft fits rotationally.

14. A toner cartridge as in claim 10 in which the slots face up and taper downwardly.

15. A toner cartridge as in claim 10 in which the toner cartridge tapers toward its top.

16. A toner cartridge as in claim 10 in which the winding mechanism includes a removable handle.

17. A toner cartridge as in claim 10 including a guard wall partially enclosing the portions of the roller facing away from the container to allow handling of a container, with the seal member wound on the roller, with reduced damage of soiling the hands or clothing of an operator.

* * * * *